US010421087B2

(12) United States Patent
Yang et al.

(10) Patent No.: US 10,421,087 B2
(45) Date of Patent: Sep. 24, 2019

(54) SPRAY GUN

(71) Applicant: Zhejiang Prulde Electric Appliance Co., Ltd., Jinhua (CN)

(72) Inventors: Weiming Yang, Jinhua (CN); Ting Han, Jinhua (CN)

(73) Assignee: Zhejiang Prulde Electric Appliance Co., Ltd., Jinhua (CN)

( * ) Notice: Subject to any disclaimer, the term of this patent is extended or adjusted under 35 U.S.C. 154(b) by 212 days.

(21) Appl. No.: 15/532,258

(22) PCT Filed: Jun. 6, 2016

(86) PCT No.: PCT/CN2016/000294

§ 371 (c)(1),
(2) Date: Jun. 1, 2017

(87) PCT Pub. No.: WO2017/181308

PCT Pub. Date: Oct. 26, 2017

(65) Prior Publication Data

US 2018/0200742 A1 Jul. 19, 2018

(30) Foreign Application Priority Data

Apr. 19, 2016 (CN) ..... 2016 1 0244911
May 30, 2016 (CN) ..... 2016 1 0375532

(51) Int. Cl.
*B05B 7/24* (2006.01)
*B05B 7/08* (2006.01)

(52) U.S. Cl.
CPC ..... *B05B 7/2408* (2013.01); *B05B 7/083* (2013.01); *B05B 7/0823* (2013.01); *B05B 7/241* (2013.01)

(58) Field of Classification Search
CPC ..... B05B 7/2478; B05B 7/24; B05B 7/2408; B05B 7/0823; B05B 7/083; B05B 15/65; B05B 7/241; B05B 7/2413; B05B 7/2494; B05B 7/02; B05B 11/06; B05B 11/00; Y10T 137/791
(Continued)

(56) References Cited

U.S. PATENT DOCUMENTS 2,424,151 A * 7/1947 Clark ..... B05B 7/2408 222/382
6,896,203 B1 * 5/2005 Restive ..... B05B 7/1254 239/302

(Continued)

*Primary Examiner* — Arthur O. Hall
*Assistant Examiner* — Tuongminh N Pham
(74) *Attorney, Agent, or Firm* — Wang Law Firm, Inc.

(57) ABSTRACT

The present invention discloses a spray gun, which comprises a gun body; a liquid container surface disposed below the gun body; a hollow connecting pipe disposed between the gun body and the liquid container. The liquid container is in communication with the interior of the gun body through the hollow connecting pipe; the liquid container has a liquid feeding hole on the top; the head portion of the gun body is located above the top of the liquid container and tilted downwardly away from the top of the liquid container. In the present invention, there is a relatively large space above the liquid feeding opening, providing an efficient space for a smooth liquid feeding operation. Liquid feeding can be performed inside the liquid container without replacing the liquid container and the liquid is ensured not to be split during the operation.

12 Claims, 8 Drawing Sheets

(58) Field of Classification Search
USPC ..... 239/525–532, 302–378; 137/533.13
See application file for complete search history.

(56) References Cited

U.S. PATENT DOCUMENTS

| | | | | |
|---|---|---|---|---|
| 2008/0093479 | A1* | 4/2008 | Delbridge | B05B 7/2408<br>239/302 |
| 2012/0318890 | A1* | 12/2012 | Hopper | B05B 7/2432<br>239/290 |
| 2014/0077002 | A1* | 3/2014 | Krayer | B05B 1/3046<br>239/314 |

* cited by examiner

SPRAY GUN

RELATE APPLICATIONS

This application is a national phase entrance of and claims benefit to PCT Application for a spray gun, PCT/CN2016/000294, filed on Jun. 6, 2016, which claims benefit to Chinese Patent Applications 201610244911.8, filed on Apr. 19, 2016, and 201610375532.2, filed on May 30, 2016. The specifications of both applications are incorporated here by this reference.

TECHNICAL FIELD OF THE INVENTION

The present invention relates to the technical field of electric tools and in particular to a spray gun.

BACKGROUND OF THE INVENTION

An electric spray gun is an apparatus which is powered by the quick release of liquid or compressed air and generally used for spraying and cleaning. In the prior art, there are spray guns of different structures according to different requirements. In the prior art, for the convenience of liquid feeding, a liquid container is generally arranged in a detachable structure. However, when in heavy workload, it is quite troublesome to detach the liquid container. In order to improve the liquid feeding efficiency, it is planned to provide a liquid feeding hole on the lid body of the liquid container. However, considering the liquid feeding effect and sealing effect in the prior art, such an arrangement is usually infeasible.

Besides, in the prior art, such as a U.S. Pat. No. 9,010,658B2, disclosed a reversible airless spray tip assembly. The tip assembly comprises, a cap having first radial bore; a rotatable cylinder disposed within the first radial bore; a spray tip having a tip, an annular projection, and a spray orifice; a sleeve having a second axial bore therethrough and is disposed within the first radial bore upstream of and abutting the spray tip; a shutoff mechanism disposed within the cap upstream of the rotatable cylinder, comprising a seat and ball; the dead zone 116 disposed between the spray tip and shutoff. The compressible materials can be eliminated when spray tip is shut off.

The tip assembly 100 comprises cylinder 112, cylinder 112 further comprises spray tip 114 and is at one end of dead zone 116; shutoff 118 comprises seat 122 and ball 120. By mating the tip 114 and the seat assembly (shutoff) 118 into one, the seal 124 can be moved out of the dead zone 116 thus reducing spit volume and energy storage.

However, in the actual operation process, the function of such a tip is limited, and the further refinement of parameter adjustment can not be achieved. Operator is not very convenient to adjust the tip.

In addition, in the prior art, for the convenience of aligning, the bodies of the spray guns are arranged in parallel. Such an arrangement has the following problems although it is very convenient for common applications.

1. After the usage of a spray gun, residual liquid remains in the head portion of the spray gun; and if the spray gun is placed horizontally, the residual liquid will drop and contaminate the operating environment.

2. When there is no enough liquid in the pot, the tube is unable to reach the liquid level, and as a result, the remaining liquid in the container body cannot be used, thus resulting in waste.

3. It is hard to spray some objects located at a high position.

These problems are problems that cannot be solved by the hand-held spray guns in the prior art. They bring inconvenience to operations although not so serious.

In the prior art, Chinese Patent Application CN104841585A (Application No. 201510272863.9, entitled CONTROLLABLE-VARIABLE SPRAY GUN) disclosed a controllable-variable spray gun, including a gun body, a booster pump and a sprayer gun connecting pipe; a water inlet of the booster pump is communicated with an irrigator pipeline of a central-pivot irrigator, and a water outlet of the booster pump is connected with a water inlet of the spray gun body through the spray gun connecting pipe; and a nozzle is provided in the front portion of the spray gun body, and the tail portion of the spray gun body is mounted at a tail end of a straddle member of the central-pivot irrigator through a spray gun horizontal-rotation mechanism. The spray gun of the present invention has the advantages that the spraying angle of the gun body can be automatically adjusted through a preset program, so that four corners of a square plot missed by the irrigator can be evenly irrigated, the land utilization rate is increased, and the landform around the square plot will not be affected.

This document proposes a concept that the spraying angle of the spray gun body can be adjusted. However, this concept is not applicable to hand-held spray guns and thus cannot bring advantageous effects.

SUMMARY OF THE INVENTION

In view of the technical problems in the prior art, a technical problem to be solved by the present invention is to provide a spray gun by which the liquid feeding efficiency of a liquid container is improved while ensuring the spraying effect, and resources in the liquid container can be used more effectively by the gun body, thereby resulting in less waste and a more humanized application process. Meanwhile, the whole design facilitates the liquid feeding process.

To solve the technical problem, the spray gun comprises a gun body having a head portion and an interior; a liquid container having a top and a bottom surface disposed below the gun body; a hollow connecting pipe disposed between the gun body and the liquid container.

Wherein the liquid container is in communication with the interior of the gun body through the hollow connecting pipe; the liquid container has a liquid feeding hole on the top; the head portion of the gun body is located above the top of the liquid container and tilted downwardly away from the top of the liquid container.

In this way, the upturning of the head portion of the gun body makes the head portion of the gun body deviate from the liquid feeding hole so that an enough space is reserved above the liquid feeding hole for a liquid feeding operation. This solves the problem in the prior art that, since the gun body and the top of the liquid container are maintained to be approximately parallel and the top of the liquid container is exactly covered, the operation of feeding liquid cannot be achieved even a liquid feeding hole is formed on the top of the liquid container.

Preferably, the gun body has a central axis tilted downwardly with respect to a horizontal plane upon which the spray gun rests, so that the bottom surface of the liquid container is tilted when the gun body is leveled horizontally.

Preferably, the liquid container comprises a container body with an opening, a lid body disposed on the top of the container body, and a sealing cover; an annular extending wall is protruded upwardly away from a top of the lid body to form the liquid feeding hole; and the sealing cover is adaptive to the extending wall to be covered on the liquid feeding hole and capable of being opened and closed. This is to reduce the volatilization of liquid inside the liquid container and also to ensure the pressure inside the liquid container when the spray gun is used. The sealing cover can be a cork blocked into the liquid feeding hole, or a threaded cover that is in threaded connection with the extending wall of the body. Such a structure is simple in processing and good in sealing effect.

For the convenience of processing, preferably, a support column is disposed between the top of the lid body and a periphery surface of the gun body, the connecting pipe is connected to the support column, and the support column, the lid body and the gun body are connected.

Preferably, a tube is connected to the bottom of the connecting pipe, an end of the tube extends toward the bottom surface of the liquid container. In this way, residual liquid after the usage is reduced, and the residual liquid is prevented from mixing with fresh liquid.

Preferably, the liquid container has a concave bottom, and the tube rests toward a rim of the concave bottom of the liquid container.

Preferably, a one-way valve assembly is disposed inside the connecting pipe at a position corresponding to an air inlet of the gun body; the one-way valve assembly comprises a positioning base, a positioning sleeve fixed inside the connecting pipe and surrounding the positioning base, an one-way valve disposed inside the positioning base, and a flow-limiting sleeve disposed at a bottom of the positioning base; and a storage chamber defined inside the positioning base and below the one-way valve; wherein the flow-limiting sleeve has a small flow-limiting hole communicating the storage chamber, the storage chamber of the positioning base can store the liquid which flows backward through the small flow-limiting hole, so as to prevent the liquid from directly flowing to the one-way valve. Such a structure is formed mainly for coordinating with the liquid container to prevent the liquid from flowing backward into the inside of the gun body.

Preferably, a spring is sleeved outside the one-way valve so that the one-way valve is better sealed.

Preferably, a core is disposed inside the gun body; the spray gun further comprises a head of a spray gun mounted on the core inside the gun body, the head of a spray gun comprises: a nozzle disposed at an end of the core having a front and a rear; a sprayer covered at the front of the nozzle having a front surface, the sprayer having a plurality of side air passing blocks with side air outlets on the front surface of the sprayer; a rotatable air volume regulating sleeve disposed at the rear of the nozzle, the rotatable air volume regulating sleeve having a front; and a sprayer nut for enclosing the nozzle, the sprayer, and the rotatable air volume regulating sleeve.

Wherein, the rotatable air volume regulating sleeve has a flange at the front of the rotatable volume regulating sleeve, the flange has a front surface, the front surface of the flange abuts the nozzle, and the front surface of the flange has a plurality of air regulating holes; the nozzle has a plurality of side air passing holes, when the rotatable air volume regulating sleeve rotates, at least one side air passing hole overlaps with at least one air regulating hole, overlapping between at least one side air passing hole and at least one air regulating hole adjust an air volume passing through the head of a spray gun.

Preferably, a pushing button is disposed on a side surface of the rotatable air volume regulating sleeve, for rotating the rotatable air volume regulating sleeve to rotate an angle.

Preferably, the nozzle has an edge and a positioning wall with at least two stopping steps is extending forward from the edge of the nozzle; the sprayer has a periphery surface and at least one protrusion is disposed on the periphery surface, the sprayer rotates to convert a spray direction between transversal and vertical; the at least one protrusion is positioned between two corresponding stopping steps of the positioning wall so as to make the sprayer to be positioned relative to the nozzle. Such a structure limits the range within which the sprayer can rotate, so as to facilitate the matching of the sprayer with each air inlet on the nozzle.

Preferably, the sprayer has a pressure relief hole, the nozzle has at least one pressure relief air inlet, the at least one pressure relief air inlet and the pressure relief hole can be aligned with each other. This structure allows air volume reduced on the side air outlets to be discharged from this hole, so as to prolong the service life of a motor. Specifically, the pressure relief air inlet and the pressure relief hole always correspond to each other. However, the rear part of the pressure relief air inlet is used in coordination with the at least one air regulating hole on the rotatable air volume regulating sleeve. When a large volume of air is required, the at least one air regulating hole on the rotatable air volume regulating sleeve corresponds to the least one side air passing hole. However, when the volume of air discharged from the at least one side air passing hole is to be reduced, the rotatable air volume regulating sleeve is rotated, so that only a part of the at least one air regulating hole corresponds to at least one side air passing hole and the other part thereof corresponds to the pressure relief air inlet. In this way, part of the airflow is discharged from the pressure relief hole to ensure that the volume of air discharged from the plurality of side air passing blocks is reduced.

Preferably, the spray gun comprises a spray-direction converting cover, wherein the sprayer nut has a front and the spray-direction converting cover is disposed at the front of the sprayer nut; a plurality of pair of bumps are protruding from an inner wall the spray-direction converting cover; each side air passing block is positioned between one pair of bumps on the spray-direction converting cover, so that the spray-direction converting cover can drive the sprayer can rotate the sprayer. By rotating the spray-direction converting cover, the spraying direction of the sprayer can be changed.

Compared with the prior art, by the inclined arrangement of the gun body and the coordination with the liquid feeding hole on the liquid container, the spray gun of the present invention allows the head portion of the gun body to be inclined upward with respect to the horizontal plane in which the liquid container is located while the tail portion of the gun body to be inclined downward. Consequently, the head portion of the gun body is slightly away from the liquid feeding hole, and the head portion of the gun body is prevented from shielding the liquid feeding hole. In this way, there is a relatively large space above the liquid feeding opening, providing an efficient space for a smooth liquid feeding operation. Liquid feeding can be performed inside the liquid container without replacing the liquid container. In addition, the liquid feeding operation is ensured not to be interfered by components of the sprayer gun during the operation.

In addition, whether in use, both replacing liquid and performing high-precision volume regulation by rotating the rotatable air volume regulating sleeve can be achieved with one hand, thus exhibiting high convenience.

DETAILED DESCRIPTION OF THE INVENTION

Figure 1:
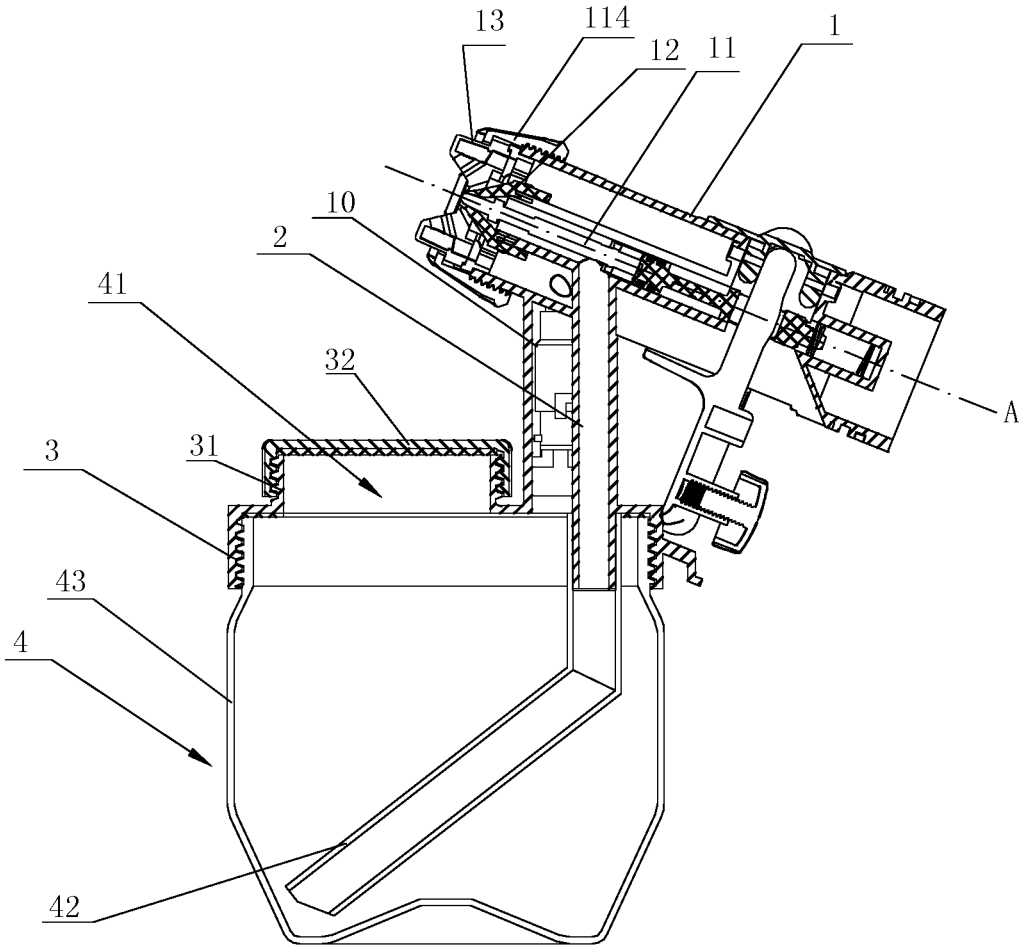
FIG. 1 is a sectional view of a spray gun according to an embodiment of the present invention.
Figure 2:
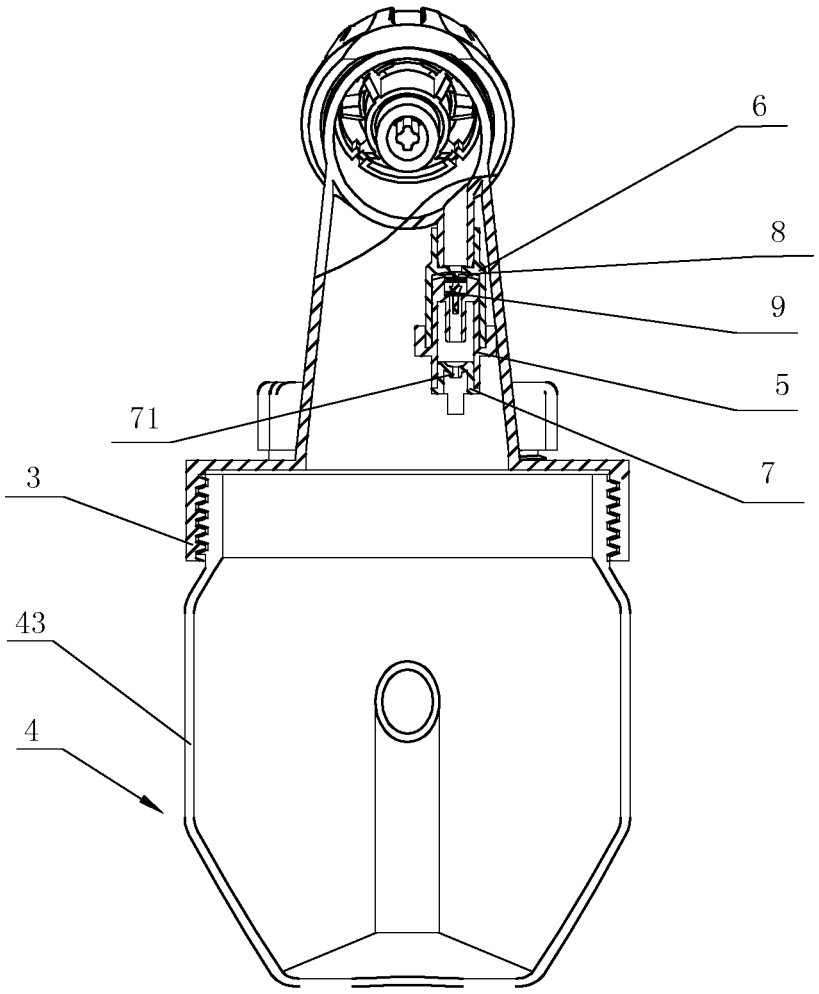
FIG. 2 is a perspective view of a one-way valve assembly according to the embodiment of the present invention.

To enable a further understanding of the present invention content of the invention herein, refer to the detailed description of the invention and the accompanying drawings below:

FIG. 1 to FIG. 10 show a spray gun according to an embodiment the present invention. The sprayer gun comprises a gun body 1 having a head portion and an interior; a liquid container 4 having a top and a bottom surface disposed below the gun body 1; a hollow connecting pipe 2 disposed between the gun body 1 and the liquid container 4;

Wherein, the liquid container 4 comprises a container body 43 with an opening, a lid body 3 disposed on the top of the container body 43, and a sealing cover 32; an annular extending wall 31 is protruded upwardly away from a top of the lid body 3 to form a liquid feeding hole 41; and the sealing cover 32 is adaptive to the extending wall 31 to be covered on the liquid feeding hole 41 and capable of being opened and closed.

In this embodiment, this sealing cover 32 is a threaded cover in threaded connection with an outer periphery of the extending wall of the lid body 3. Such a structure is simple and convenient in processing; and when in use, liquid can be fed just by unscrewing the sealing cover 32. The sealing cover 32 can also be a slider disposed inside the lid body 3. Such an arrangement is more invisible and convenient to use. However, for product processing, this arrangement is high in both processing difficulty and production cost.

The connecting pipe 2 is disposed between the top of the lid body 3 and the gun body 1, the bottom end of the connecting pipe 2 is extended below the lid body 3, and the hollow connecting pipe 2 communicates the interior of the liquid container 4 with the spraying channel inside the gun body 1.

In addition, a support column 10 is disposed between the top of the lid body 3 and a periphery surface of the gun body 1, the connecting pipe 2 is connected to the support column 10, and the support column 10, the lid body 3 and the gun body 1 are connected and the three are manufactured integrally.

A tube 42 is connected to the bottom of the connecting pipe 2, an end of the tube 42 extends toward the bottom surface of the liquid container 4. The liquid container 4 has a concave bottom, and the tube 42 rests toward a rim of the concave bottom of the liquid container 4.

The head portion of the gun body 1 is tilted downwardly away from the top of the liquid container 4, so that the head portion of the gun body 1 is deviated from liquid feeding hole 41 on the top of the liquid container 4; and the tail portion of the gun body is inclined downward with respect to the horizontal plane of the liquid container 4. That is, there is an included angle between the central axis A of the gun body 1 and the horizontal plane upon which the spray gun rests, so that the bottom surface of the liquid container 4 is tilted when the gun body 1 is leveled horizontally. This included angle is appropriately 15° to 45°. In this embodiment, this included angle is 22°.

A one-way valve assembly is disposed inside the connecting pipe 2 at a position corresponding to an air inlet of the gun body 1; the one-way valve assembly comprises a positioning base 5, a positioning sleeve 6 fixed inside the connecting pipe 2 and surrounding the positioning base 5, an one-way valve 8 disposed inside the positioning base 5, and a flow-limiting sleeve 7 disposed at a bottom of the positioning base 5; and a storage chamber defined inside the positioning base 5 and below the one-way valve 8; wherein the flow-limiting sleeve 7 has a small flow-limiting hole 71 communicating the storage chamber to prevent liquid from flowing backward, the storage chamber of the positioning base 5 can store the liquid which flows backward through the small flow-limiting hole 71, so as to prevent the liquid from directly flowing to the one-way valve 8. A spring 9 is sleeved outside the one-way valve 8 so that the one-way valve 8 is better sealed. Such an arrangement ensures that liquid inside the container body will not flow backward into the gun body.

Compared with the prior art, the present invention improves the liquid feeding efficiency of the liquid container 4 while ensuring the spraying effect. By opening the sealing cover 32 arranged on the liquid feeding hole 41, liquid can be fed without replacing the liquid container 4. In this way, resources in the liquid container can be used more effectively by the gun body 1, thereby resulting in less waste. In addition, there is an included angle between the central axis A of the gun body 1 and the horizontal plane of the space in which the spray gun is located; and due to this included angle, it can be ensured that the head of a spray gun will not block the liquid feeding hole 41 during the liquid feeding process. Thus, a space for the liquid feeding operation is reserved.

Figure 3:
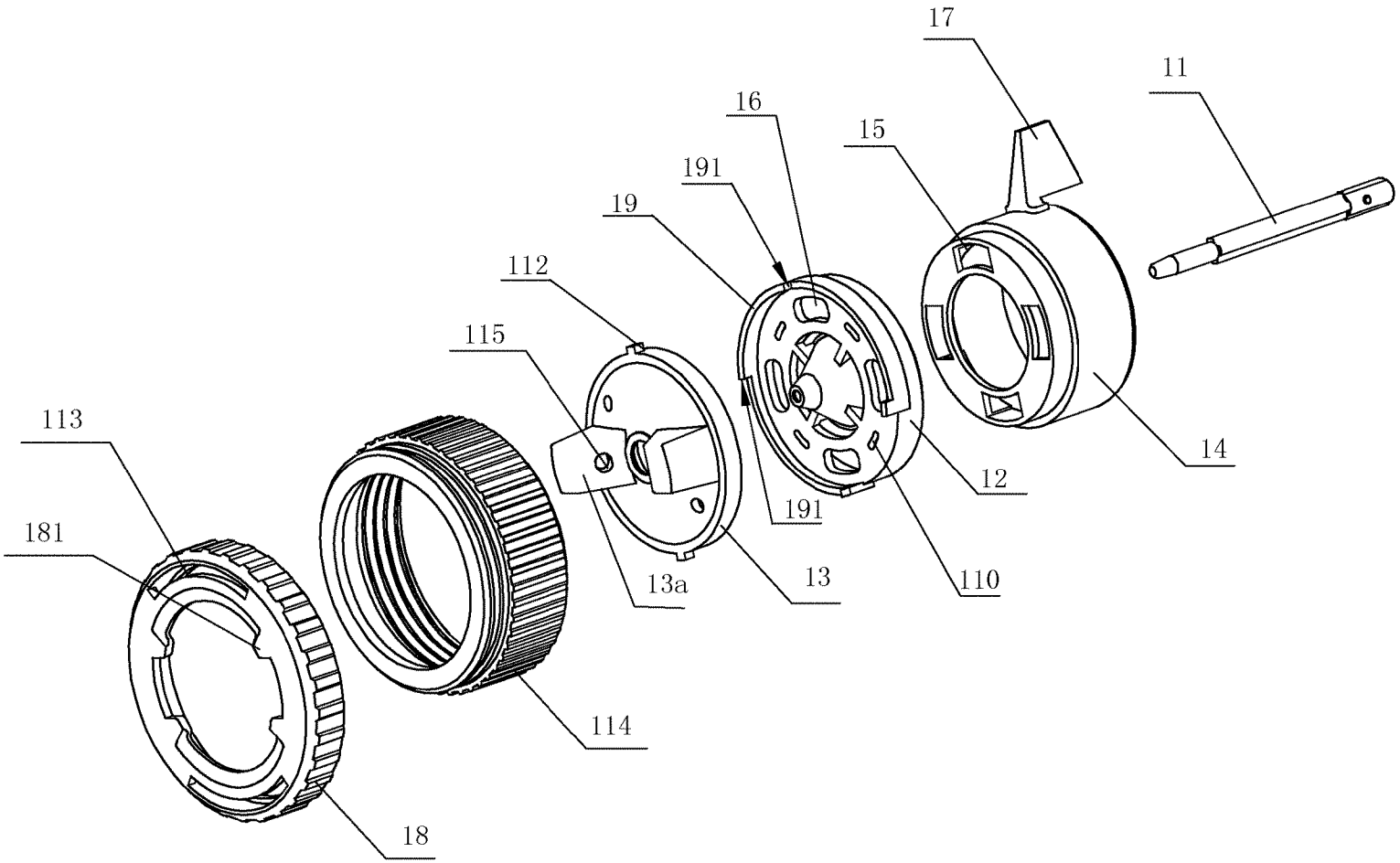
FIG. 3 is an exploded view of a head of a spray gun according to the embodiment of the present invention.
Figure 4:
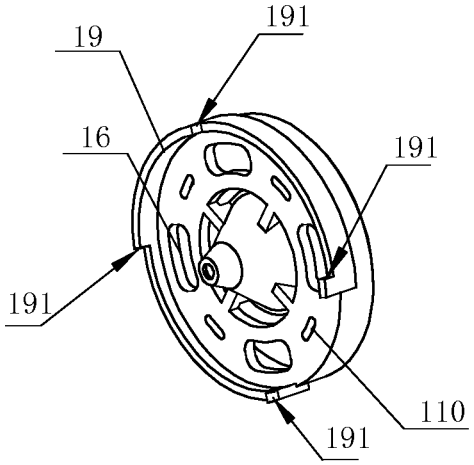
FIG. 4 is a perspective view of a nozzle of the head of a spray gun according to the embodiment of the present invention.
Figure 5:
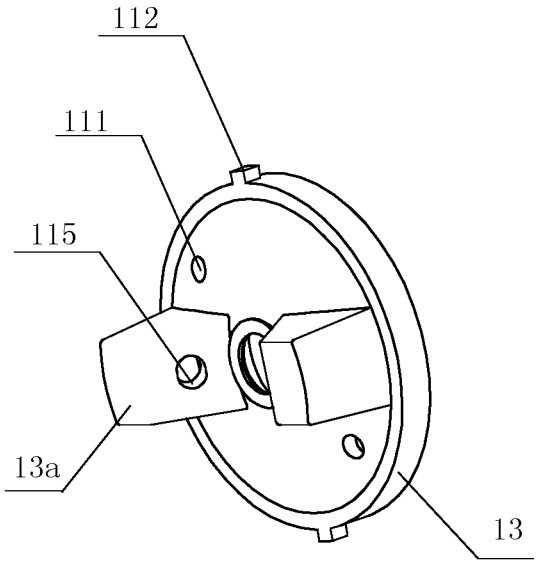
FIG. 5 is a perspective view of a sprayer of the head of a spray gun according to the embodiment of the present invention.
Figure 6:
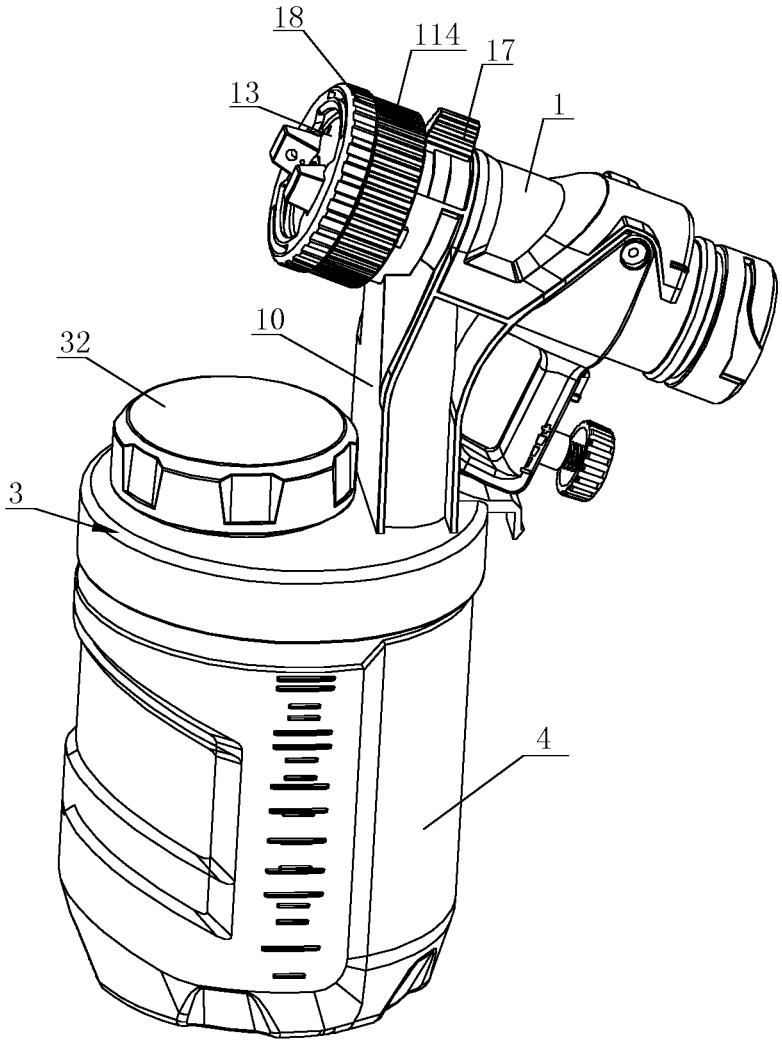
FIG. 6 is a perspective view of the spray gun according to the embodiment of the present invention.
Figure 7:
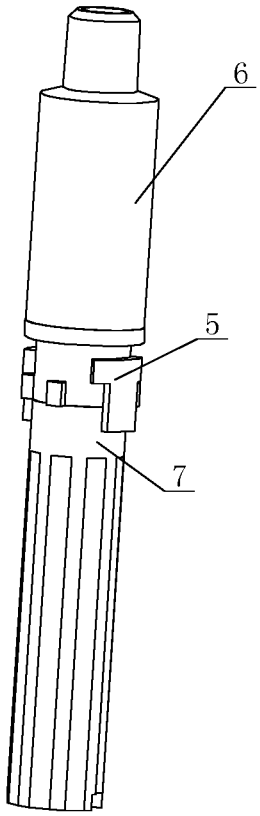
FIG. 7 is another perspective view of the one-way valve assembly according to the embodiment of the present invention.
Figure 8:
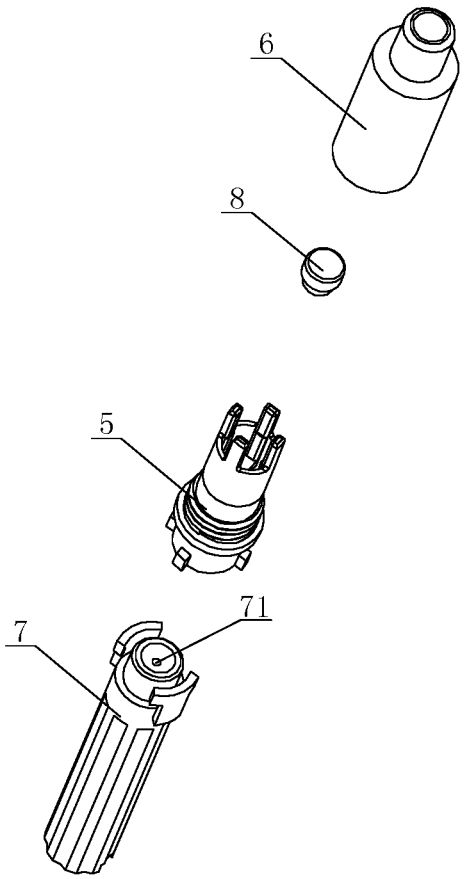
FIG. 8 is an exploded view of the one-way valve assembly according to the embodiment of the present invention.
Figure 9:
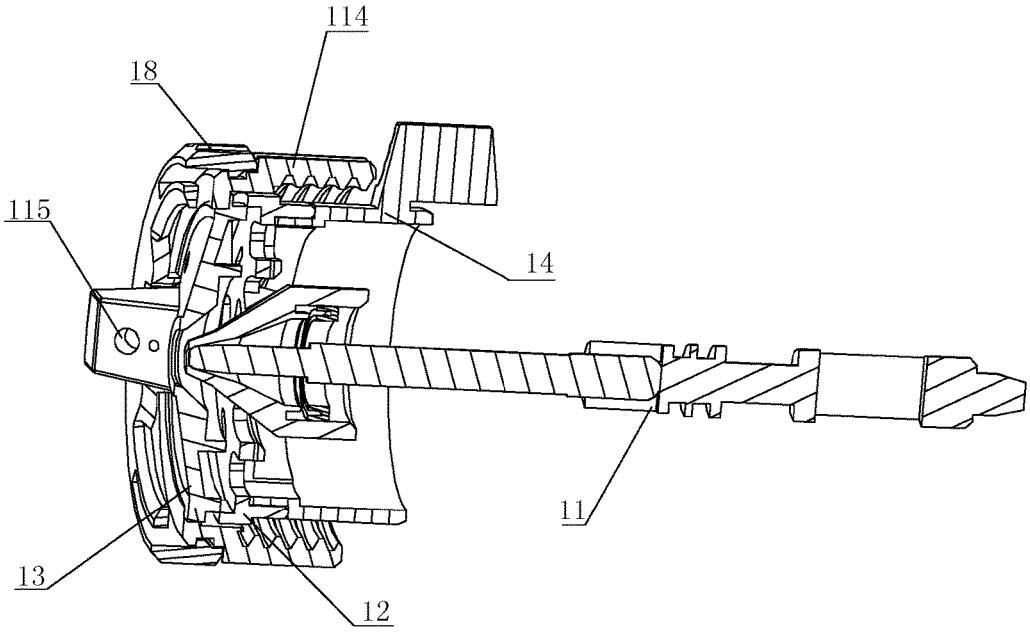
FIG. 9 is a sectional view of the head of a spray gun according to the embodiment of the present invention.
Figure 10:
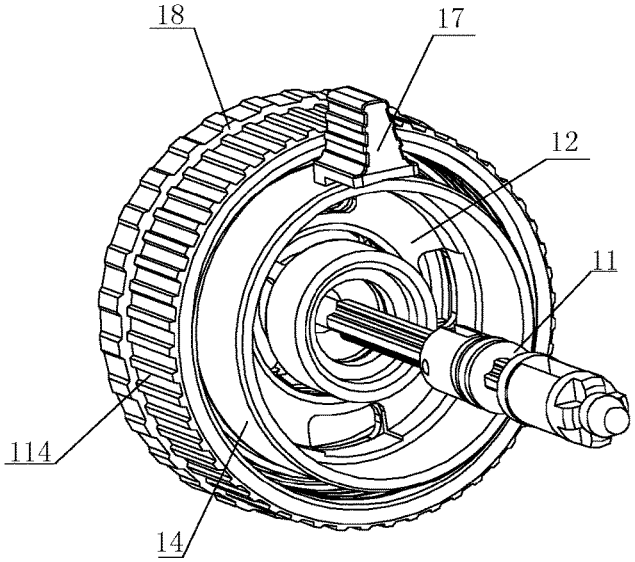
FIG. 10 is a perspective view of the head of a spray gun according to the embodiment of the present invention.

FIG. 3 to FIG. 5 show a head of a spray gun according to an embodiment the present invention. The head of a spray gun is mounted on a core 11 inside a spray gun body;

the head of a spray gun comprises a nozzle 12 having a front and a rear; a sprayer 13 having a front surface; a rotatable air volume regulating sleeve 14 having a front; and a sprayer nut 114 for enclosing the nozzle 12, the sprayer 13, and the rotatable air volume regulating sleeve;

wherein, the nozzle 12 is disposed at an end of the core 11; the sprayer 13 is covered at the front of the nozzle 12 having a plurality of side air passing blocks 13*a* with side air outlets 115 on the front surface of the sprayer 3; the rotatable air volume regulating sleeve 14 is disposed at the rear of the nozzle 12 and has a flange at the front of the rotatable volume regulating sleeve 14, the flange has a front surface, the front surface of the flange abuts the nozzle 12, and the front surface of the flange has a plurality of air regulating holes 15; the nozzle 12 has a plurality of side air passing holes 16, when the rotatable air volume regulating sleeve 14 rotates, at least one side air passing hole 16 overlaps with at least one air regulating hole 15, overlapping between at least one side air passing holes 16 and at least one air regulating hole 15 adjust an air volume passing through the head of a spray gun; and the whole structure is connected by the sprayer nut 114. A pushing button 17 is disposed on a side surface of the rotatable air volume regulating sleeve 14, for rotating the rotatable air volume regulating sleeve 14 to rotate an angle The nozzle has an edge and a positioning wall 19 with at least two stopping steps 191 is extending forward from the edge of the nozzle 12; the sprayer has a periphery surface and at least one protrusion 112 is disposed on the periphery surface, the sprayer 13 rotates to convert a spray direction between transversal and vertical; the at least one protrusion 112 is positioned between two corresponding stopping steps 191 of the positioning wall 19 so as to make the sprayer 13 to be positioned relative to the nozzle 12. The sprayer 13 has a pressure relief hole 111, the nozzle 12 has at least one pressure relief air inlet 110, the at least one pressure relief air inlet 110 and the pressure relief hole 111 can be aligned with each other.

When in use, an operator adjusts the at least one air regulating hole 15 on the rotatable air volume regulating sleeve 14 by stirring the push button 17, so that the volume of air discharged from the side air outlets 115 is adjusted, and the width in a horizontal, vertical, flat or square direction is thus regulated. The spray gun further comprises a spray-direction converting cover 18, wherein the sprayer nut 114 has a front and the spray-direction converting cover 18 is disposed at the front of the sprayer nut 114; a plurality of pair of bumps 181 are protruding from an inner wall the spray-direction converting cover 18; each side air passing block 13*a* is positioned between one pair of bumps 181 on the spray-direction converting cover 18, so that the spray-direction converting cover 18 can drive the sprayer 13 can rotate the sprayer 13. All the operations can be performed directly with one hand during the spraying process, thus exhibiting high convenience.

It should be noted that the arrangement of the sprayer structure in the present invention depends upon the actual operating methods. During the actual operation, when the spray gun of the present invention is used, if the head of a spray gun is maintained to be horizontal, the gun body will have a certain inclined angle. Therefore, using a special head of a spray gun structure not only brings convenience to operations of an operator, more importantly, improves the spraying effect. The positioning accuracy and fineness of spraying will be enhanced.

The invention claimed is:

1. A spray gun comprising:

a gun body having a head portion and an interior;

a liquid container having a top and a bottom surface disposed below the gun body;

a hollow connecting pipe disposed between the gun body and the liquid container;

wherein a core is disposed inside the gun body, the liquid container is in communication with the interior of the gun body through the hollow connecting pipe;

the liquid container has a liquid feeding hole on the top;

the head portion of the gun body is located above the top of the liquid container and tilted downwardly away from the top of the liquid container;

the head portion of the gun body is mounted on the core inside the gun body, the head portion of the gun body comprising:

a nozzle disposed at an end of the core having a front, a rear, and a plurality of side air passing holes;

a sprayer covered at the front of the nozzle having a front surface, the sprayer having a plurality of side air passing blocks with side air outlets on the front surface of the sprayer;

a rotatable air volume regulating sleeve disposed at the rear of the nozzle, the rotatable air volume regulating sleeve having a front and a flange, the flange having a front surface, the front surface of the flange abuts the nozzle, and the front surface of the flange having a plurality of air regulating holes;

and a sprayer nut for enclosing the nozzle, the sprayer, and the rotatable air volume regulating sleeve;

when the rotatable air volume regulating sleeve rotates, at least one side air passing hole overlaps with at least one air regulating hole, overlap between at least one side air passing hole and at least one air regulating hole adjusts an air volume passing through the head portion of the gun body.

2. The spray gun of claim 1, wherein the gun body has a central axis tilted downwardly with respect to a horizontal plane upon which the spray gun rests, so that the bottom surface of the liquid container is tilted when the gun body is leveled horizontally.

3. The spray gun of claim 1, wherein the liquid container further comprises a container body with an opening and a top, a lid body disposed on the top of the container body, and a sealing cover;

an annular extending wall is protruded upwardly away from a top of the lid body to form the liquid feeding hole; and the sealing cover is adaptive to the extending wall to be covered on the liquid feeding hole and capable of being opened and closed.

4. The spray gun of claim 3, wherein a support column is disposed between the top of the lid body and a periphery surface of the gun body, the connecting pipe is connected to the support column, and the support column, the lid body and the gun body are connected.

5. The spray gun of claim 1, wherein a tube is connected to the bottom of the connecting pipe, an end of the tube extends toward the bottom surface of the liquid container.

6. The spray gun of claim 5, wherein the liquid container has a concave bottom, and the tube rests toward a rim of the concave bottom of the liquid container.

7. The spray gun of claim 1, further comprising a one-way valve assembly is disposed at a position corresponding to an air inlet of the gun body; the one-way valve assembly comprises a positioning base, a positioning sleeve fixed inside the connecting pipe and surrounding the positioning base, a one-way valve disposed inside the positioning base, and a flow-limiting sleeve disposed at a bottom of the positioning base; and a storage chamber defined inside the positioning base and below the one-way valve;

wherein the flow-limiting sleeve has a flow-limiting hole communicating with the storage chamber, the storage chamber of the positioning base can store the liquid which flows backward through the flow-limiting hole, so as to prevent the liquid from directly flowing to the one-way valve.

8. The spray gun of claim 7, further comprising a spring sleeved outside the one-way valve.

9. The spray gun of claim 1, wherein a pushing button is disposed on a side surface of the rotatable air volume regulating sleeve, for rotating the rotatable air volume regulating sleeve to rotate an angle.

10. The spray gun of claim 1, wherein the nozzle has an edge and a positioning wall with at least two stopping steps is extending forward from the edge of the nozzle;

the sprayer has a periphery surface and at least one protrusion is disposed on the periphery surface, the sprayer rotates to convert a spray direction between transversal and vertical;

the at least one protrusion is positioned between two corresponding stopping steps of the positioning wall so as to make the sprayer to be positioned relative to the nozzle.

11. The spray gun of claim 1, wherein the sprayer has a pressure relief hole, the nozzle has at least one pressure relief air inlet, the at least one pressure relief air inlet and the pressure relief hole can be aligned with each other.

12. The spray gun of claim 1, further comprising a spray-direction converting cover, wherein the sprayer nut has a front and the spray-direction converting cover is disposed at the front of the sprayer nut;

a plurality of pair of bumps are protruding from an inner wall the spray-direction converting cover;

each side air passing block is positioned between one pair of bumps on the spray-direction converting cover, so that the spray-direction converting cover can drive the sprayer can rotate the sprayer.

* * * * *